US007513299B2

(12) United States Patent
Ruttley

(10) Patent No.: US 7,513,299 B2
(45) Date of Patent: Apr. 7, 2009

(54) MAGNETIC TOOL FOR RETRIEVING METAL OBJECTS FROM A WELL BORE WHEN USING COIL TUBING

(75) Inventor: David J. Ruttley, Marrero, LA (US)

(73) Assignee: Rattler Tools, Inc., Harvey, LA (US)

( * ) Notice: Subject to any disclaimer, the term of this patent is extended or adjusted under 35 U.S.C. 154(b) by 67 days.

(21) Appl. No.: 11/598,902

(22) Filed: Nov. 15, 2006

(65) Prior Publication Data

US 2007/0107894 A1 May 17, 2007

Related U.S. Application Data

(63) Continuation of application No. 11/089,277, filed on Mar. 24, 2005, now abandoned, which is a continuation-in-part of application No. 10/935,367, filed on Sep. 7, 2004.

(30) Foreign Application Priority Data

Aug. 31, 2004 (VE) ..... 2.004-1414

(51) Int. Cl.
*E21B 31/08* (2006.01)

(52) U.S. Cl. ..... 166/66.5; 166/99; 166/311; 175/308; 175/320; 175/328

(58) Field of Classification Search ..... 166/311, 166/99, 66.5; 175/308, 320, 328
See application file for complete search history.

(56) References Cited

U.S. PATENT DOCUMENTS

| | | | | |
|---|---|---|---|---|
| 2,729,494 | A * | 1/1956 | Trowbridge | 294/65.5 |
| 2,830,663 | A | 4/1958 | Kirby | |
| 3,637,033 | A * | 1/1972 | Mayall | 175/320 |
| 6,354,386 | B1 | 3/2002 | Ruttley | |
| 6,357,539 | B1 | 3/2002 | Ruttley | |
| 6,655,462 | B1 * | 12/2003 | Carmichael et al. | 166/311 |
| 7,219,724 | B2 * | 5/2007 | Theriot, Sr. | 166/66.5 |

* cited by examiner

*Primary Examiner*—Kenneth Thompson
*Assistant Examiner*—Nicole Coy
(74) *Attorney, Agent, or Firm*—Keaty Professional Law Corporation

(57) ABSTRACT

A magnetic tool for retrieval of metal debris from a well bore particularly adapted for use in coil tubing systems. The tool has a cylindrical body and a plurality of separate magnet assemblies mounted on the tool body. The magnet assemblies are separated by spacers, which define a secondary settling area for the metal objects attracted to the magnetic tool. Each magnet assembly has one or more magnet member encased in a protective sleeve

14 Claims, 3 Drawing Sheets

MAGNETIC TOOL FOR RETRIEVING METAL OBJECTS FROM A WELL BORE WHEN USING COIL TUBING

CROSS-REFERENCE TO RELATED APPLICATIONS

This application is a continuation of my prior application Ser. No. 11/089,277 filed on Mar. 24, 2005 entitled "Magnetic Tool for Retrieving Metal Objects From a Well Bore When Using Coil Tubing," abandoned, which is a continuation-in-part of my co-pending application Ser. No. 10/935,367 filed on Sep. 7, 2004 entitled "Magnetic Tool for Retrieving Metal Objects from a Well Bore," which claims priority of my prior application in Venezuela, application Ser. No. 2.004-01414 filed on Aug. 31, 2004 entitled "Magnetic Tool for Retrieving Metal Objects from a Well Bore", the full disclosures of which are incorporated by reference herein and priority of which is hereby claimed.

BACKGROUND OF THE INVENTION

The present invention relates to wellbore tools and more particularly to a magnetic tool for retrieval of metal objects, such as cuttings and other foreign objects that accumulate in the process of perforating or milling over bridge plugs and other down hole obstructions from a wellbore.

As the conventional petroleum resources are becoming more difficult to access, the industry started developing means for drilling in more difficult strata, often in high-pressure or less stable environments. A new technique called coiled tubing drilling has been used in places where air drilling, mud drilling or fluid drilling are impracticable. Instead of conventional vertical drill string, the coil tubing method uses a continuous string of concentric coil tubing, which allows fluid circulation through the tubing. Coil tubing drilling is believed to reduce formation damage as it allows for drilling with less contact between a drill string and the surrounding formation. An additional advantage of coiled tubing method is related to continuous circulation while drilling, which is believed to minimize pressure fluctuations and reduces formation damage.

However, similar to conventional technique, coiled tubing method generates metal cuttings, or shavings, which have to be removed to stimulate fluid circulation. The present invention contemplates provision of a magnetic tool for retrieval of metal objects from a well bore when using coil tubing drilling method.

SUMMARY OF THE INVENTION

It is, therefore, an object of the present invention to provide an apparatus for retrieval of metal cuttings and other foreign objects from a wellbore, which can be used in a coil tubing system.

It is another object of the present invention to provide a magnetic tool for retrieving metal objects from a well bore that forms secondary debris settling area between magnet members.

These and other objects of the present invention are achieved through a provision of a magnetic tool adapted for retrieval of metal objects from a well bore. The tool has an elongated mandrel, which carries a plurality of spaced-apart magnet assemblies detachably mounted on the mandrel. The mandrel has a central opening therethrough to allow fluid circulation through the tool. Opposite ends of the tool carry connectors for securing the tool in a drill string.

Each magnet assembly comprises one or more magnet members encased in a protective sleeve, which is made from a non-corrosive, structurally stable material. Each magnet assembly has a generally ring-shaped cross section and end portions having a generally frustoconical configuration. One of the embodiments provides for a magnet member having a unitary ring-shaped configuration. Another embodiment provides for the magnet assemblies having three of more elongated magnet members, which have a magnet encased in a protective sleeve.

Mounted between adjacent magnet assemblies is a tubular spacer, the exterior surface of which forms a secondary settling area for the metal objects attracted to the magnet assemblies. By strategically spacing the magnet assemblies along the length of the tool body, it is possible to create a magnetic field strong enough to cause metal objects to settle on the spacer(s).

BRIEF DESCRIPTION OF THE DRAWINGS

Reference will now be made to the drawings, wherein like parts are designated by like numerals and wherein.

DETAIL DESCRIPTION OF THE PREFERRED EMBODIMENT

Figure 1:
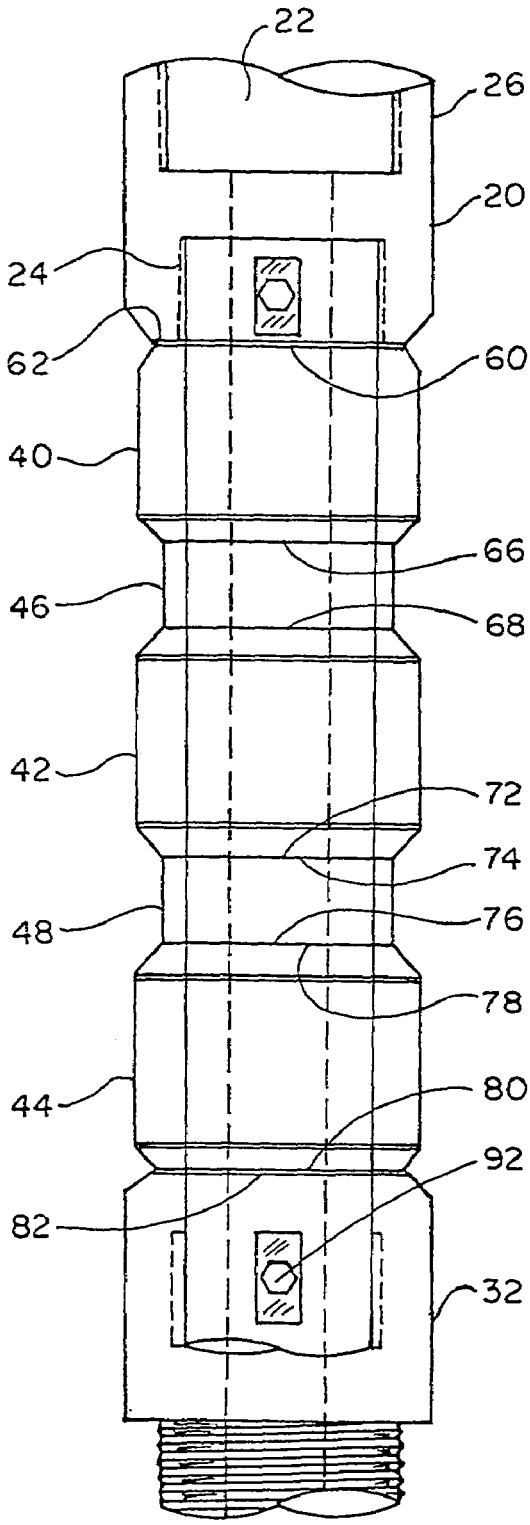
FIG. 1 is a perspective view of tile first embodiment of the apparatus of the present invention.

Turning now to the drawings in more detail, numeral 10 designates the well bore magnetic tool in accordance with the first embodiment of the present invention. The tool 10 comprises a tubular cylindrical mandrel, or body 12 having a through opening 14 for admitting circulating fluid into a wellbore. An upper part 16 of the cylindrical body 12 is provided with external threads 18. The upper part 16 carries an upper connector member 20, which threadably detachably engages the upper part 16.

The upper connector member is provided with a central opening 22. The walls of the inner opening 22 are provided with two sets of internal threads. A lower set of internal threads 24 threadably matchingly engages with the threads 18 of the mandrel 12. An upper set of threads 26 is adapted for engagement with other subs forming a drill string (not shown).

A lower part 30 of the mandrel 12 carries a lower connector member 32, which has an enlarged diameter portion 34 and a reduced diameter portion 36. The reduced diameter portion 36 is provided with external threads 38. The threads 38, similarly to the threads 26 allow connection of the tool 10 to other subs forming the drill string (not shown).

Mounted in a surrounding relationship over the mandrel 12, between the upper connector 20 and the lower connector 32 is a plurality of magnet assemblies 40, 42, and 44. The tool 10 may be provided with one or more magnet assemblies, depending on the design selected by the manufacturer. The magnet assemblies 40, 42, and 44 are vertically spaced from each other. The outer surface of each of the magnet members defines a primary settling area for the metal debris.

Figure 6:
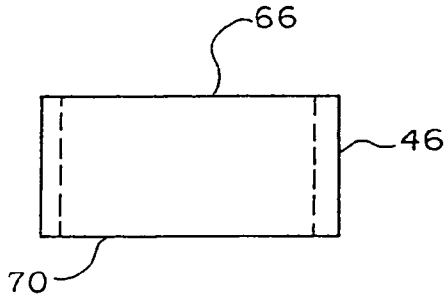
FIG. 6 is a detail elevation view of a spacer member of the first embodiment of the apparatus of the present invention.
Figure 7:
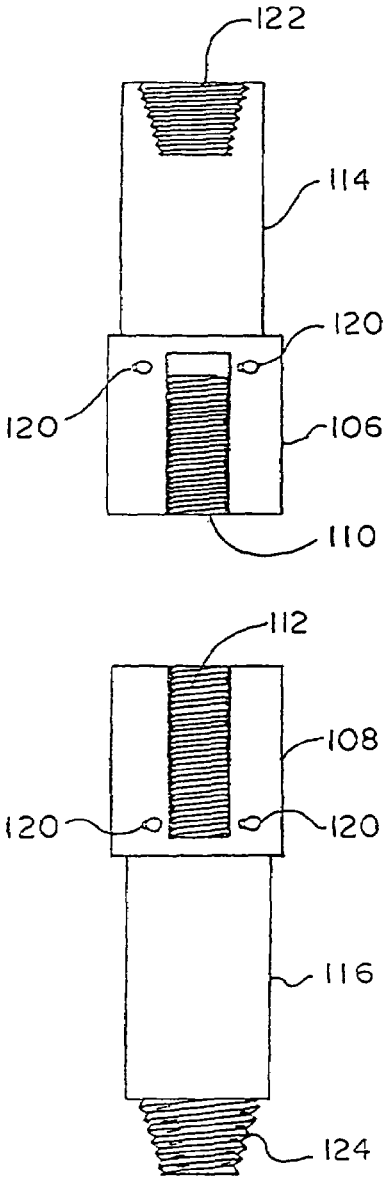
FIG. 7 is a detail view showing magnetic tool connectors of the second embodiment of the present invention engaged with top and bottom subs.
Figure 8:
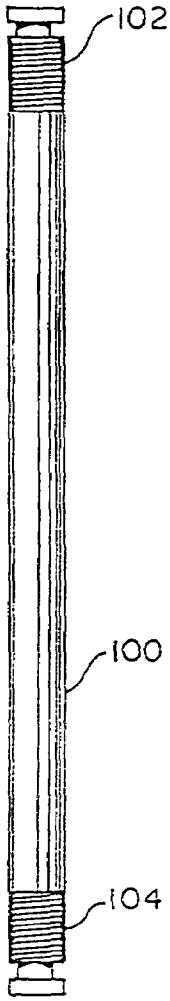
FIG. 8 is detail view of a mandrel of the magnet tool of the second embodiment of the present invention.
Figure 9:
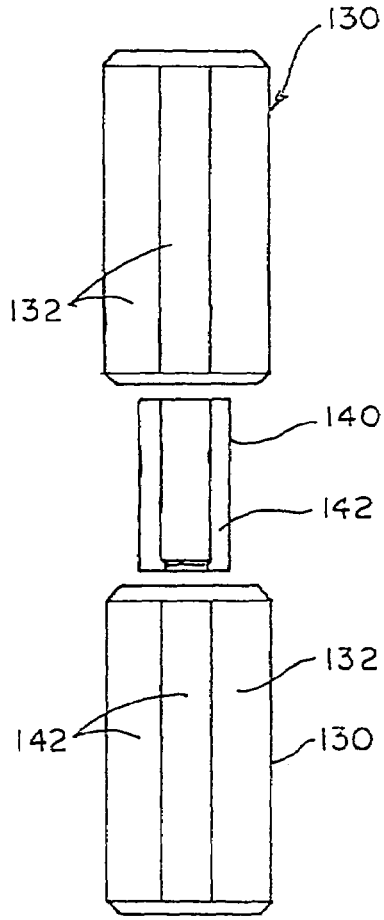
FIG. 9 is a detail exploded view showing magnet assemblies and spacer members of the second embodiment of the present invention.
Figure 10:
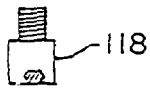
FIG. 10 is a detail view of set screw for securing the connector members to the mandrel.
Figure 11:
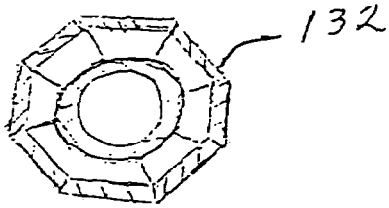
FIG. 11 is a cross sectional view of a magnet assembly of the second embodiment of this invention, showing an open polygonal shape of the magnet member and a corresponding sleeve.

One or more tubular spacers 46, 48 (FIG. 6) are positioned on the mandrel 12 between the magnet assemblies 40, 42, and 44; the spacers 46, 48 form secondary debris settling areas between adjacent magnet members. Due to the pre-determined spacing of the magnet assemblies on the mandrel 12, the magnetic field created by adjacent magnets overlaps the areas 46, 48, causing metal debris to settle on the exterior of the spacers 46 and 48, as well.

Figure 4:
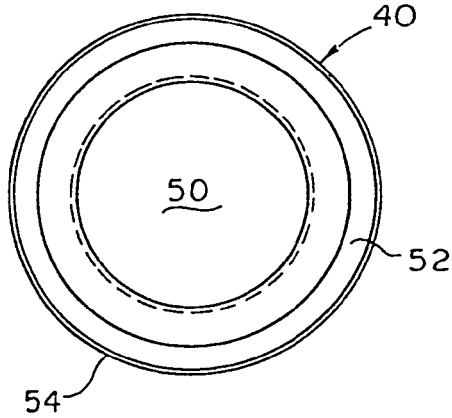
FIG. 4 is a cross-sectionial view of a magnet assembly of the first embodiment of the apparatus of the present invention taken along lines 4-4 of FIG. 3.

As can be seen in the drawings, each of the magnet members 40, 42, and 44 comprises a body having a generally ring-shaped cross-section with a central opening therethrough. Each magnet assembly 40, 42, and 44 comprises a magnet member 52 completely encased in a metal sleeve 54 (FIG. 4). The sleeve 54 may be formed from a non-corrosive structurally stable material, such as for instance stainless steel. Each magnet assembly has a generally tubular configuration. The sleeve 54 has an upper portion 56, which is shaped as a truncated cone. As can be seen in the drawings, each magnet member is encased in a sleeve 54 mounted in contact with a respective magnet member.

Each sleeve 54 comprises a lower portion 58, which also has a generally frustoconical configuration, such that the upper and lower edges of the sleeve 54 are configured with smaller diameters than the remaining portion of the sleeve body.

An upper edge 60 of each sleeve 54 of the magnet assembly 40 contacts a lower edge 62 of the upper connector 20 and matches its reduced diameter size. A lower edge 64 of the magnet assembly 40 contacts and rests on an upper edge 66 of the spacer 46. The external diameter of the spacer body substantially matches the size of the edge 64, supporting the magnet assembly 40 on the mandrel 12 matches the size of the edge 64, supporting the magnet assembly 40 on the mandrel 12.

In a similar manner, an upper edge 68 of the magnet assembly 42 contacts a bottom edge 70 of the spacer 46, while a lower edge 72 contacts and rests on a top edge 74 of the spacer 48. Also similarly, an upper edge 78 of the magnet assembly 44 contacts the lower edge 76 of the spacer 48, while a lower edge 80 rests on a top edge 82 of the connector 32. As a result, the magnet assemblies and the spacers are "threaded" on the mandrel 12, supporting each other and retaining each other on the mandrel 12. The magnet assemblies and the spacers are detachably mounted on the mandrel 12.

Figure 2:
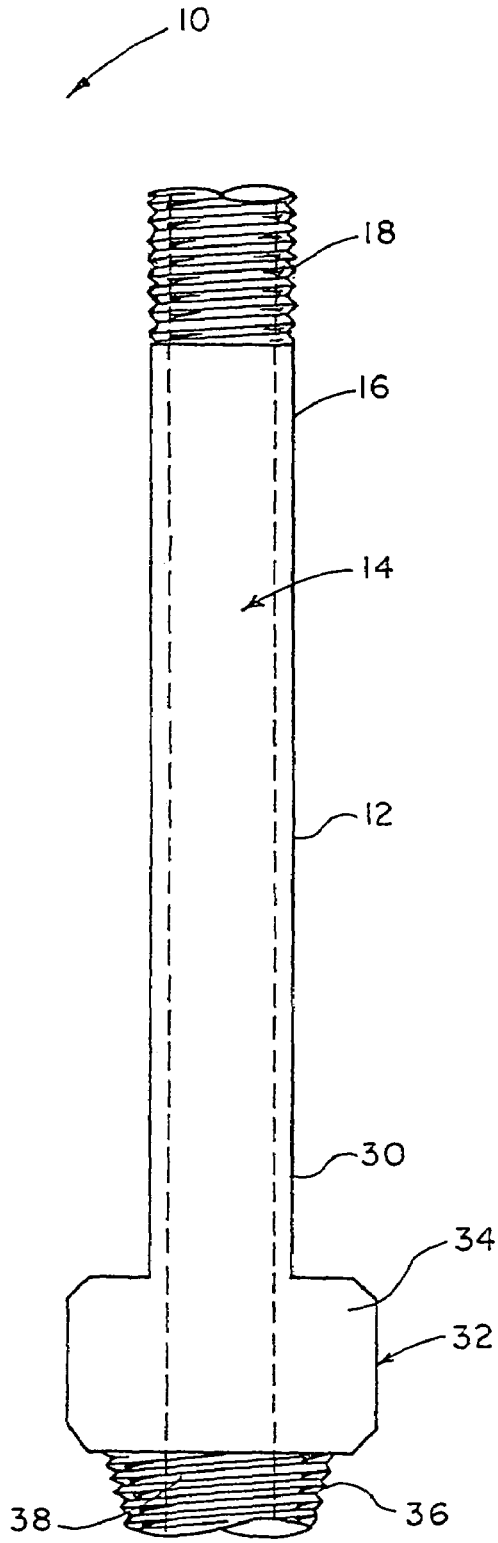
FIG. 2 is a perspective view of the mandrel of the magnetic tool of first embodiment of the present invention.
Figure 3:
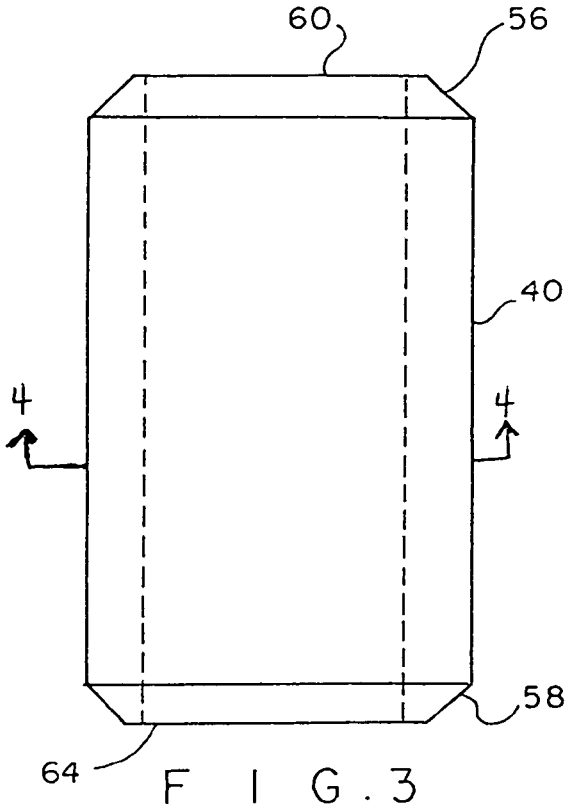
FIG. 3 is an elevation view of the magnet member of the first embodiment of the apparatus of the present invention.
Figure 5:
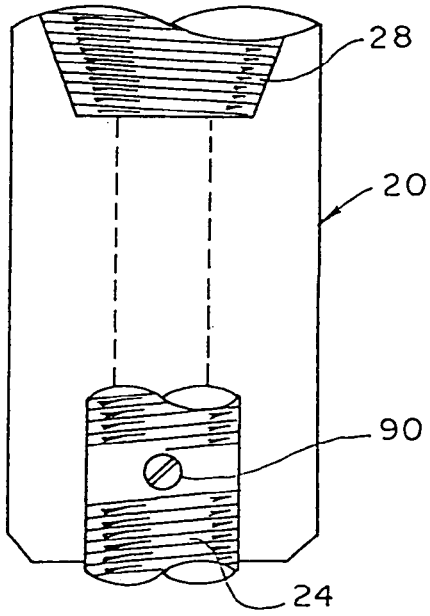
FIG. 5 is a detail elevation view of a connector member of the first embodiment of the apparatus of the present invention.

The mandrel 12 shown in FIG. 2 illustrates the lower connector member 32 unitary formed with the main body of the mandrel 12. If desired, the connectors 20 and 32 may be secured on the mandrel 12 with set screws 90, 92, as shown in FIGS. 1 and 5.

Turning now to FIGS. 7-10, the magnetic tool of the second embodiment of the present invention is shown. Similarly to the first embodiment, the magnetic tool of the second embodiment comprises an elongated tubular mandrel 100 having top 102 and bottom 104 threaded portions. A top connector member 106 and bottom connector member 108 are each provided with internal threaded portions 110 and 112, respectively, which match the threads on the mandrel portions 102 and 104.

A top sub 114 and a bottom sub 116 is secured to the top connector 106 and the bottom connector, respectively. Set screws 118 are configured for positioning into drilled openings 120 formed in the top connector member 106 and the bottom connector member 108. The openings 120 are trilled and tapped to receive the set screws 118. The top sub 114 has internal threads 122 for connecting to the drill string (not shown). The bottom sub 116 has external threads 124 for connection to other equipment lowered into a well bore (not shown).

The magnet assemblies of the second embodiment are each formed as tubular members with a central opening therethrough. In this embodiment, each magnet assembly 130 is made of a plurality of elongated magnet members 132, which are secured together to form an open center polygon in cross section. Each magnet member 132 extends longitudinally, in a generally parallel relationship to the central axis of the tool. Each magnet member 132, similarly to the first embodiment, has a magnet encased in a sleeve. Depending on a particular design, the magnet assembly 130 may have three or more magnet members 132.

Mounted between adjacent magnet assemblies 130 is a spacer member 140, which also has a generally ring-shaped cross section. The spacer member 140 comprises a plurality of elongated plates 142, which extend longitudinally in a generally parallel relationship to the central axis of the tool 100. Depending on design, the spacer member 140 may be formed with three or more plates 142. As can be seen in FIG. 4, the plates 142 are similar to the magnet members 132 and form an open center polygon in cross section.

It is envisioned that the tool 100 may be particularly beneficial in the environment, where manufacturing constraints require construction of magnet assemblies and spacer members from a plurality of smaller parts. An additional advantage may be that individual magnet assemblies 132 are easier to replace when damaged or worn. The same may be true for individual plates 142 of the spacer member 140.

It will be understood that the relative dimensions of the magnet assemblies, spacers and connectors may differ, depending on the particular design of the magnetic tool 10. If desired, the magnet assemblies may have a vertical dimension of between 3"-6", while the spacers may have a vertical dimension of 0.5"-2". The external diameter of the connector members may be between 2" and 3", while the diameter of the opening 50 may be 1"-1.5". Of course, other dimensions may be successfully employed, when desired.

Many changes and modifications may be made in the design of the present invention without departing from the spirit thereof. I, therefore, pray that my rights to the present invention be limited only by the scope of the appended claims.

I claim:

1. An apparatus for retrieving metal objects from a wellbore, comprising:

a cylindrical tool body with a central opening therethrough;

a plurality of spaced-apart magnet assemblies configured for positioning in a surrounding relationship over at least a portion of said tool body, said magnet assemblies defining a primary settling area for the metal objects, each of said magnet assemblies comprising a magnet member encased in a sleeve mounted in contact with a respective magnet member and the tool body; and at least one spacer mounted between adjacent magnet assemblies, said spacer member defining a secondary settling area for the metal objects, an external diameter of said spacer being smaller than an external diameter of each of said magnet assemblies, and wherein each of said magnet assemblies and said spacer is capable of being detachably slidably mounted on said tool body to facilitate removal of each of said magnet assemblies and said spacer for repair and maintenance.

2. The apparatus of claim 1, wherein each of said magnet assemblies has a generally ring-shaped cross-section.

3. The apparatus of claim 2, wherein each of said magnet assemblies comprises a plurality of elongated magnet members circumferentially disposed about the tool body and extending in a generally parallel relationship to a central axis of the tool body.

4. The apparatus of claim 1, wherein said sleeve is configured to follow exterior configuration of a respective magnet member.

5. The apparatus of claim 4, wherein said sleeve comprises a generally cylindrical main portion and opposing end portions having a generally frustoconical configuration.

6. The apparatus of claim 1, wherein said at least one spacer has a generally tubular configuration.

7. The apparatus of claim 6, wherein said at least one spacer comprises a plurality of elongated plates disposed in a circumferential relationship about said tool body and extending in a generally parallel relationship to a central axis of the tool body.

8. The apparatus of claim 1, wherein said tool body is provided with an upper connector located above said magnet assemblies and a lower connector located below said magnet assemblies, said upper connector and said lower connector allowing connection of said tool body to a drill string lowered into the well bore.

9. An apparatus for retrieving metal objects from a wellbore, comprising:

a cylindrical tool body with a central opening therethrough;

at least a pair of spaced-apart magnet assemblies configured for positioning in a surrounding relationship over at least a portion of said tool body, said magnet assemblies defining a primary settling area for the metal objects, each of said magnet assemblies comprising a magnet member encased in a sleeve mounted in contact with a respective magnet member and the tool body; and at least one tubular spacer mounted between said magnet assemblies in a surrounding relationship to said tool body, said spacer member defining a secondary settling area for the metal objects, an external diameter of said spacer being smaller than an external diameter of each of said magnet assemblies, and wherein each of said magnet assemblies and said spacer is capable of being detachably slidably mounted on said tool body to facilitate removal of each of said magnet assemblies and said spacer for repair and maintenance.

10. The apparatus of claim 9, wherein each of said magnet assemblies comprises a magnet member encased in a sleeve configured to follow exterior configuration of a respective magnet member.

11. The apparatus of claim 10, wherein said sleeve is formed from a non-corrosive material.

12. The apparatus of claim 10, wherein said sleeve comprises a generally cylindrical main portion and opposing end portions having a generally frustoconical configuration.

13. An apparatus for retrieving metal objects from a wellbore, comprising:

a cylindrical tool body with a central opening therethrough; and at least a pair of spaced-apart magnet assemblies configured for positioning in a surrounding relationship over at least a portion of said tool body, said magnet assemblies defining a primary settling area for the metal objects, each of said magnet assemblies comprising a plurality of elongated magnet members secured in a surrounding relationship over at least a portion of said tool body and extending in a generally parallel relationship to a central axis of the tool body, each of said magnet assemblies comprising a magnet member encased in a sleeve mounted in contact with a respective magnet member and the tool body; and at least one tubular spacer mounted between said magnet assemblies in a surrounding relationship to said tool body, said spacer member defining a secondary settling area for the metal objects, an external diameter of said spacer being smaller than an external diameter of each of said magnet assemblies, and wherein each of said magnet assemblies and said spacer is capable of being detachably slidably mounted on said tool body so as to facilitate removal of each of said magnet assemblies and said spacer for repair and maintenance.

14. The apparatus of claim 13, wherein said at least one spacer comprises a plurality of elongated plates disposed in a circumferential relationship about said tool body and extending in a generally parallel relationship to a central axis of the tool body.

* * * * *